United States Patent [19]

Pryor

[11] 4,111,763

[45] Sep. 5, 1978

[54] PROCESS FOR IMPROVING CORROSION RESISTANT CHARACTERISTICS OF CHROME PLATED ALUMINUM AND ALUMINUM ALLOYS

[75] Inventor: Michael J. Pryor, Woodbridge, Conn.

[73] Assignee: Swiss Aluminium Ltd., Chippis, Switzerland

[21] Appl. No.: 816,315

[22] Filed: Jul. 18, 1977

[51] Int. Cl.[2] ..... C25D 5/44; C25D 5/30; B32B 15/20

[52] U.S. Cl. ..... 204/38 A; 106/300; 423/76; 423/96; 427/419 A; 428/336; 428/472

[58] Field of Search ..... 204/42, 38 A, 33; 428/469, 472, 336; 106/299, 300; 423/69, 71, 96, 76; 427/419 A, 419 B

[56] References Cited

U.S. PATENT DOCUMENTS

| | | | |
|---|---|---|---|
| 2,407,809 | 9/1946 | Blackmun | 204/38 A |
| 2,898,490 | 8/1959 | Damon | 204/42 X |
| 3,114,660 | 12/1963 | Cochran | 204/38 A |
| 3,531,381 | 9/1970 | Amore et al. | 204/38 A |
| 3,650,815 | 3/1972 | Ghoshtagore | 428/336 X |
| 3,927,243 | 12/1975 | Theisen et al. | 428/469 X |
| 3,945,899 | 3/1976 | Nikaido et al. | 428/469 |
| 4,018,631 | 4/1977 | Hale | 428/469 X |
| 4,052,530 | 10/1977 | Fonzi | 428/469 X |
| 4,066,816 | 1/1978 | Sheasby et al. | 428/469 X |
| 4,070,255 | 1/1978 | Hasegawa et al. | 204/42 |

*Primary Examiner*—Harold Ansher

*Attorney, Agent, or Firm*—Gregory P. LaPointe; Robert H. Bachman

[57] ABSTRACT

The invention relates to a method for preparing aluminum and aluminum alloy objects for plating which results in an article which exhibits improved corrosion resistant characteristics. The process includes anodizing the aluminum object in an acid bath, placing the anodized object in contact with a chemical which impregnates and is absorbed by the oxidized crystalline surface and finally exposing the treated aluminum object to heat so that the impregnating chemical is pyrolyzed to form an electronically conductive oxide thereby permitting the plating process while preserving an anodic coating of high ionic resistance.

8 Claims, No Drawings

PROCESS FOR IMPROVING CORROSION RESISTANT CHARACTERISTICS OF CHROME PLATED ALUMINUM AND ALUMINUM ALLOYS

BACKGROUND OF THE INVENTION

The present invention relates to a process for improving the corrosion resistant characteristics of chrome plated aluminum ad aluminum alloys.

Chrome may be plated onto aluminum in a variety of fashions. For instance, copper may first be plated on cleaned aluminum followed by the plating of a nickel layer upon which is finally plated chrome. Chrome may be plated directly upon a carefully cleaned aluminum surface. Many additional techniques have been proposed for chrome plating aluminum, two of the more common methods of surface preparation prior to chrome plating being the zincating and phosphoric anodizing process. The zincating process as shown in U.S. Pat. No. 1,627,900 involves depositing a thin layer of zinc by immersion of the aluminum article in sodium zincate solution. The anodizing process as shown in U.S. Pat. No. 1,947,981 requires the production of a thin porous anodic coating on an aluminum substrate by anodizing the aluminum article in aqueous phosphoric acid.

The corrosion resistance of aluminum and aluminum alloys treated by the aforesaid techniques is relatively poor, particularly under conditions of high chloride ion concentration. The coatings that have metallic layers between the chrome and the aluminum are prone to promote severe galvanic corrosion of the aluminum substrate at small pores in the outer chrome layer. This would normally be anticipated from the very active galvanic potential of aluminum, the noble potential of the chromium and many of the components in the intervening metallic layers. Somewhat surprising is the poor behavior of the barrier coating put on by anodizing aluminum and aluminum alloys in phosphoric acid. It would normally be expected that such a coating would have a significant protective effect against galvanic corrosion. Since this coating has extremely large pore diameters, it appears evident that any protection of the aluminum substrate is only provided by that thin barrier layer coating which is continuous. It appears evident that this thin barrier layer coating is adversely affected by the acid nature of the chrome plating bath.

The present invention contemplates a method of treating aluminum and aluminum alloys prior to plating which improves their corrosion resistant characteristics.

Accordingly, it is the principal object of this invention to provide an improved process for enhancing the corrosion resistant characteristics of chrome plated aluminum and aluminum alloys.

It is a further object of this invention to provide a process for pretreating aluminum and aluminum objects prior to plating which will produce a coating which is electronically conductive while still maintaining a coating of high ionic resistance.

It is still a further object of this invention to provide an effective and economical process for preparing aluminum and aluminum alloy surfaces which can be readily chrome plated by standard plating techniques.

SUMMARY OF THE INVENTION

In accordance with the present invention, the foregoing objects and advantages may readily be obtained.

The present invention contemplates a multi-stepped treatment of aluminum and its alloys which produces an electronically conductive coating which can be plated by standard plating procedures while maintaining high corrosion resistance. The process comprises anodizing the aluminum object in an acid bath to produce a relatively thick and insulating anodic coating, placing the anodized aluminum object in contact with a chemical solution which is capable of impregnating and being absorbed by the oxide crystalline surface, and finally exposing said treated object to heat so that the impregnating chemical solution is pyrolyzed to produce an electronically conductive oxide thereby permitting plating by standard procedures and at the same time, preserving an anodic coating of high ionic resistance.

It can be appreciated that the process of the present invention is an effective and economical method of treating aluminum and aluminum alloy surfaces which can be readily chrome plated by standard plating techniques while preserving high corrosion resistance due to the high ionic resistance of the infiltrated anodic coating.

DETAILED DESCRIPTION

The present invention relates to an improved process for pretreating aluminum and aluminum alloys prior to conventional chrome or copper-nickel-chrome plating. In particular, the process is directed to the anodizing of an aluminum object in an aqueous sulphuric acid electrolyte in such a manner as to produce a relatively thick anodic coating. The invention contemplates producing an anodic coating of a thickness between 0.1 and 1.0 mils, optimally between 0.3 and 0.8 mils.

In accordance with the present invention, the aluminum object acts as the anode in the anodizing process. Utilizing a sulphuric acid bath, the following reaction is considered to take place at the cathode thereby liberating $H_2$: $4H_3O^+ + 4E \rightleftarrows 4H_2O + 2H_2$. The following reaction is considered to take place at the anode: $2Al^{+++} + 3H_2O \rightleftarrows Al_2O_3 + 6H^+$. Of course, it is well known that a substantial proportion of sulphate is included in this type of oxide coating.

In operation, the aluminum objects are first subjected to a cleaning process. The proper cleaning cycle and cleaning material will depend on several factors, e.g., the type of final finish desired, the amount of soil and the kind of soil. If it is necessary to remove unusual accumulation of soil, auxiliary cleaning, i.e., vapor degreasing or spray washing could be performed prior to the anodizing operation.

In accordance with the present invention, the electrical parameters of the anodizing process are controlled so as to provide a relatively thick anodic coating. The thickness of the coating should be between 0.1 and 1.0 mils, optimally between 0.3 and 0.8 mils. The concentration of the electrolyte bath should be between 5 and 30 percent by weight sulphuric acid, and optimally between 10 and 20 percent by weight. The voltage range should be between 5 and 30 volts, and optimally between 10 and 20 volts. The temperature of the acid bath can vary from 10° C. to 90° C., optimally 20° C. to 50° C. The time for anodizing should be adjusted to give the desired thickness range required as the growth of the anodic coating is essentially linear with respect to time. An example of operating conditions are:

Temperature: 30° C.

Voltage: 15 Volts

Acid Bath Concentration: 12 percent by weight $H_2SO_4$

Time: 30 minutes

The above operating conditions will yield an anodic coating of around 0.5 mil thickness. It should be understood that the specific values cited above are not restrictive, but are determined by coating requirements.

After anodizing the aluminum substrate, the anodized surface is washed in cold water to remove any residual sulphuric acid. However, after rinsing, the aluminum object is not sealed in the conventional sense, as for instance, by prolonged immersion in boiling water, boiling water containing nickel acetate or impregnating with wax-like bodies.

In accordance with the present invention, the unsealed anodized aluminum article is exposed to a solution of a metal salt which is capable of being pyrolyzed to an electronically conductive oxide. Examples of suitable metal salts include, but are not limited to, stannous chloride and ortho-butyl titanate. The article may be exposed to the metal salt solution by being immersed therein, or alternately, having the article electrochemically sprayed or painted with the metal salt solution. In a first example, the anodized aluminum object is immersed in an aqueous stannous chloride bath. The concentration of the aqueous stannous chloride is not critical, the concentration range being between 1 and 50 grams per liter. A bath temperature of 10° C. to 30° C. is sufficient. The stannous chloride impregnates and is absorbed by the unsealed oxide crystalline surface of the aluminum object. In contrast to processes in which discontinuous metallic nuclei are formed in the comparatively large parallel sided pores which exist normal to the metal in these anodic coatings to aid in subsequent electroless plating as shown in U.S. Pat. No. 3,929,594, primary absorption of stannous chloride in the present invention is into the microporous mass of the anodic coating. The aluminum object should be exposed in the aqueous stannous chloride bath until uptake of the stannous chloride solution is complete. The uptake is extremely rapid, never requiring more than 5 minutes to be completed. After the oxide crystalline surface of the aluminum object is impregnated with the stannous chloride, the object is then heated in air to convert the stannous chloride to an electronically conductive stannous oxide. A typical pyrolysis cycle would involve heating in air between 300° C. and 600° C. for 1 to 60 minutes. Optimally, a temperature of between 400° C. and 500° C. should be used. The rate of heat up and cooling is not critical for corrosion resistance. However, it may be critical with respect to maintaining good mechanical properties in heat treatable Al-Zn-Mg, Al-Zn-Mg-Cu, Al-Cu, Al-Cu-Mg and Al-Mg-Si systems. Here, cooling rates in excess of 100° C. per minute are required. After the infiltration-pyrolysis cycle is completed, the anodic coating is saturated with stannous oxide which is electronically conductive and, therefore, capable of being plated by standard plating procedures using direct chrome plate or intermediate barrier layers of double nickel or copper and nickel. The high corrosion resistance of the aluminum part can be attributed to the high ionic resistance of the infiltrated anodic coating. The ability to plate directly upon the stannous oxide is attributable to the electronic conductibility of the coating.

In a second example, the oxide crystalline surface of the anodized aluminum object is infiltrated with ortho-butyl titanate, in a similar manner as previously described, except that low molecular weights of aliphatic alcohols are preferred as the solvent. From here, the procedure differs. The pyrolysis cycle of the infiltrated coating is conducted in a heated hydrogen atmosphere within the temperature range of 300° C. to 600° C. for 1 to 60 minutes, preferably within a 350° C. to 500° C. temperature range. This pyrolysis cycle produces a highly conductive $Ti_2O_3$ oxide which provides sufficient electronic conductivity to the infiltrated anodic coating so as to allow subsequent chrome plating with or without intermediate barrier layers as described in the previous example. The infiltration and pyrolysis cycle is carried on in a reducing atmosphere until the anodic coating is completely saturated with $Ti_2O_3$, the time range being between 1 and 60 minutes. After the pyrolysis cycle, the aluminum object is chrome plated by standard procedures. Thereafter, the plated aluminum article can be heated in air within a range of 200° C. to 400° C. to transform the $Ti_2O_3$ to a highly insulating rutile, $TiO_2$, which provides premium corrosion resistance since the insulating substrate exhibits extremely high ionic plus electronic resistance. This treatment can obviously be concluded with an age hardening step to maintain good mechanical properties.

While the present invention has been described in conjunction with advantageous embodiments, the invention contemplates the use of other pyrolyzable metal salts that yield electronically conductive fine grain oxides which are readily chrome plated by standard techniques irrespective of whether these oxides can be transformed to a more electronically resistant form by post-plating pyrolysis. In addition, the acid bath which the aluminum object is anodized need not be limited to sulphuric acid but could also include oxalic acid, phosphoric acid or any combinations thereof.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for preparing aluminum and aluminum alloy objects for chrome plating by standard plating techniques and enhancing the corrosion resistance thereof, said process comprising anodizing said object in an acid bath to form an anodic coating, impregnating said anodic coating with a pyrolyzable metal salt, and pyrolyzing said impregnated anodic coating to form an electronically conductive oxide thereby allowing plating of said object by standard plating techniques.

2. A process according to claim 1 wherein said anodic coating is between 0.1 and 1.0 mils thick.

3. A process according to claim 1 wherein said bath consists of sulphuric acid.

4. A process according to claim 3 wherein said concentration of said sulphuric acid is between 5 and 30 percent by weight.

5. The process according to claim 4 wherein said anodizing takes place at a voltage between 5 and 30 volts, at a temperature between 10° C. to 90° C. for a time of up to 30 minutes whereby an anodic coating of between 0.1 and 1.0 mils thick is formed.

6. A process according to claim 1 wherein said pyrolyzing takes place at a temperature of between 300° C. to 600° C. for a time of up to 60 minutes.

7. The process according to claim 1 wherein said pyrolyzable metal salt is ortho-butyl titanate.

8. A process according to claim 7 wherein the plated aluminum object is heated to a temperature of between 200° C. to 400° C. to transform the electronically conductive oxide to a highly insulating rutile which exhibits high ionic plus electronic resistance.

* * * * *